US008341794B1

(12) United States Patent
Sales

(10) Patent No.: US 8,341,794 B1
(45) Date of Patent: Jan. 1, 2013

(54) TRAILER HITCH RECEIVER AND CLEANING DEVICE COMBINATION

(76) Inventor: Federick A. Sales, Amityville, NY (US)

( * ) Notice: Subject to any disclaimer, the term of this patent is extended or adjusted under 35 U.S.C. 154(b) by 1209 days.

(21) Appl. No.: 11/897,830

(22) Filed: Sep. 4, 2007

Related U.S. Application Data

(63) Continuation-in-part of application No. 11/880,902, filed on Jul. 25, 2007, now abandoned.

(51) Int. Cl.
*B08B 9/04* (2006.01)
*B08B 1/00* (2006.01)

(52) U.S. Cl. ..... 15/104.05; 15/111; 15/160; 15/206; 134/8; 280/504

(58) Field of Classification Search ..... 15/106, 15/111, 112, 113, 118, 229.13, 229.11, 229.12, 15/210.1, 211, 159.1, 104.05, 160, 164, 206; 451/523, 524, 525, 557, 558, 61; 132/75.3, 132/76.4, 75.6, 76.5; 134/8; 280/504
See application file for complete search history.

(56) References Cited

U.S. PATENT DOCUMENTS

| | | | | | |
|---|---|---|---|---|---|
| 445,212 | A | * | 1/1891 | West | 451/503 |
| 1,180,191 | A | * | 4/1916 | Rosser | 451/524 |
| 1,487,075 | A | * | 3/1924 | Olson et al. | 132/309 |
| 3,582,140 | A | * | 6/1971 | Kaufman et al. | 300/21 |
| 4,353,143 | A | * | 10/1982 | Beaudoin et al. | 15/104.066 |
| 4,825,597 | A | * | 5/1989 | Matechuk | 451/524 |
| 5,479,673 | A | * | 1/1996 | Carton | 15/111 |
| 5,596,786 | A | * | 1/1997 | Kluiters | 15/119.2 |

* cited by examiner

*Primary Examiner* — Gary Graham
(74) *Attorney, Agent, or Firm* — Leo G. Lenna

(57) ABSTRACT

A brush for cleaning a trailer hitch receiver that comprises an elongated stem attached to a handle at one end and a cleaning head at the opposite end. The brush is configured so that a person can grasp the handle of the device and ream the cleaning head having at least two flat abrasive sides into the trailer hitch receiver so as to clean out accumulated salt, asphalt, rust debris from the receiver hitch. A method for cleaning a substantially square trailer hitch receiver using the aforementioned cleaning device.

10 Claims, 4 Drawing Sheets

TRAILER HITCH RECEIVER AND CLEANING DEVICE COMBINATION

CROSS REFERENCE

This application is a continuation-in-part of U.S. Ser. No. 11/880,902 filed Jul. 25, 2007 now abandoned entitled "Wire Brush for Cleaning Square Trailer Receiver" which is herein incorporated in its entirety by reference.

FIELD OF THE INVENTION

The present invention relates to a cleaning tool, and more particularly, a cleaning device for cleaning a trailer hitch receiver.

DESCRIPTION OF THE PRIOR ART

Numerous innovations for brushing devices have been provided in the prior art that will be described. Even though these innovations may be suitable for the specific individual purpose to which they address, however, they differ from the present invention.

A FIRST EXAMPLE, U.S. Patent Office Document No. 1,110,856, contents of which is herein incorporated in its entirety by reference, Issued Sep. 15, 1914, to Anderson teaches a chimney cleaner, comprising a threaded rod having at its upper end an eye for connection with supporting mechanism, the opposite end of the rod being reduced, the rod having a plain portion at the inner end of the reduced portion, the remainder of the reduced portion being threaded, a bearing ring journaled on the plain portion and provided with traverse openings arranged at angular intervals of 90 degrees with respect to each other, a link engaging each opening, a nut thread on to the rod above the bearing ring and provided with transverse openings corresponding in number and position to the openings of the ring, a link for each opening, each link having an eye engaging the opening, washers on the rod above the bearing ring and below the nut, nuts on the inner sides of the washers, each of the links having an eye at its outer end and the upper links registering with the lower links, a pair of plates connecting the eyes of the adjacent links, a bar pivoted to the lower end of each plate, the bars of the plates pivoted to the lower end of each plate, the bars of the plates in the same plane converging downwardly, a plate connecting the converging ends of each pair of bars, and a series of cleaning devices supported by each bar and each of the last-named plates, and a similar cleaning device supported by each pair of first-named plates, each of the cleaning devices comprising a rd bent upon itself to form a body, and a pair of parallel arms, each consisting of two portions arranged at an angle with respect to each other and connected by a bearing coil, each bar having spaced pairs of bearing lugs and each of the last-named plates having similar lugs at its ends, a bolt supported by each pair of lugs, the coils of the cleaning devices engaging the bolts, and weights on the body portions of the cleaning devices of the bars.

A SECOND EXAMPLE, U.S. Patent Office Document No. 1,500,886, Issued on Jul. 8, 1924, the contents of which is herein incorporated in its entirety by reference, to Nelson teaches a brush comprising four substantially L-shaped bristle carrying brush sections originally arranged in the form of a square and having their adjacent ends in overlapping relation, means positioned directly upon adjacent ends of certain diametrically opposite ones of the overlapped ends of the bristle carrying brush sections for adjustably securing the adjacent ends together, and means carried by the first mentioned means for adjustably connected securing the opposite adjustably connected sections together.

A THIRD EXAMPLE, U.S. Patent Office Document No. 1,545,355, Issued on Jul. 7, 1925, the contents of which is herein incorporated in its entirety by reference, to Roth teaches a flue cleaner comprising an upper, a lower and an intermediate scraper member group holder disk, a clamping disk abutting each of the holder disks, spacing means between the projecting from each of the holder disks and arranged in a polygonal-shaped group having horizontally disposed outer scraping sides, on e disposed at right angles to the other, and means for detachably clamping the disks together to secure the sets in position.

A FORTH EXAMPLE, U.S. Patent Office Document No. 4,108,162, Issued on Aug. 22, 1978, to Chikashige et al., the contents of which is herein incorporated in its entirety by reference, teaches a scrapper brush for collecting cells from internal body passages that includes a twisted wire root portion mounting hairy fibers the twisted wires, and a flexible wire winding. A tip portion of the winding is stretched to the present an increased pitch, and the root portion is threaded into the tip portion with the lay of the twisted wires matching the increased pitch. An additional stretched portion may be provided to increase the flexibility of the brush.

A FIFTH EXAMPLE, U.S. Patent Office Document No. 4,310,942, Issued on Jan. 19, 1982, to Krape., the contents of which is herein incorporated in its entirety by reference, teaches an apparatus for cleaning chimneys from a position at the bottom thereof comprising a brush cleaning member and a self-contained pulley system whereby the entire apparatus climbs the chimney from bottom to top in a stepwise fashion due to the actuation of two sets of retracting legs thereby cleaning the entire length of the chimney. The apparatus may be used interchangeably accommodate different size brushes and legs so that various chimney and flue sizes and shapes can be cleaned.

A SIXTH EXAMPLE, U.S. Patent Office Document No. 4,353,143, Issued on Oct. 12, 1982, to Beaudoin et al., the contents of which is herein incorporated in its entirety by reference, teaches a conduit cleaning apparatus suited for manually cleaning elongated pipes, with particular reference to chimneys, that has a unitary flexible pushing member of spring steel having a predetermined rectangular cross section providing sufficient stiffness to operate a brush within a chimney, including the transfer of thrust through a significant angle of curvature, while permitting elastic deformation of the pushing member so as to traverse sharp corners encountered in certain clean cuts, and also for close coiling within a carrying frame.

The brush, which is detachably mounted on an attachment adaptor secured to one of the pushing member has a plurality of stiff tines delectably mounted on spring means to permit a significant degree of coning of the brush in either direction during insertion or withdrawal past an obstruction. The arrangement permits the use of brushes of shaped platform, to accord with the cross-sectional shape of the conduit being cleaned. A clamping handle through which the pushing member is inserted permits the ready application of pushing or pulling effort to the pushing member.

A SEVENTH EXAMPLE, U.S. Patent Office Document No. 4,819,291, Issued on Apr. 11, 1989, to Gunjian, the contents of which is herein incorporated in its entirety by reference, teaches a cleaning brush that has a handle, an elongated stem formed from a flexible coil spring, bristles at the end of the stem and a stiff member extending axially within the coil spring from the handle a distance partly the length of the stem to allow flexibility only in the area between the end of the stiff member and the bristle portion.

AN EIGHT EXAMPLE, U.S. Patent Office Document No. 5,253,386, Issued on Oct. 19, 1993, to LaLonde teaches a brush for a hollow structure with an open end that includes brush bristles secured to a twisted wire. In one embodiment, a nonabrasive, heat-shrinking plastic tube is slip-fitted over the twisted wire at a section thereof that is free of brush bristles. The heat-shrinking plastic tube is heat-shrunk to form a tight fit with the twisted wire form a brush handle therewith. In another embodiment, a non-abrasive solid cylindrical body is penetrated along the axis or center line thereof by a selection of twisted wire that is free of brush bristles.

AN NINTH EXAMPLE, U.S. Patent Office Document No. 5,295,278 Issued on Mar. 22, 1994, to Condon et al. teaches a cleaning tool for preparing the surfaces of pipes and fittings for soldering, welding or gluing which comprises a base and a pair of opposing prongs. The tool further includes a distal set of replaceable brushes for cleaning the inner surfaces of pipes or fittings and a proximal set of replaceable abrasive pads for cleaning the outer surfaces of pipes and fittings. The tool is configured to accommodate pipes and fittings of a variety of diameters.

It is apparent now that numerous innovations fro brushing devices have been provided in the prior art that are adequate for various purposes. Furthermore, even though these innovations may be suitable for the specific individual purposes to which they address, accordingly, they would not be suitable for the purposes of the present invention as heretofore described. Therefore, what is needed is a cleaning device that is designed to clean a hitch receiver.

SUMMARY OF THE INVENTION

AN OBJECT of the present invention is to provide a cleaning device for cleaning a square trailer receiver that avoids the disadvantages of the prior art.

ANOTHER OBJECT of the present invention is to provide a cleaning device for cleaning a square trailer hitch receiver that is simple and inexpensive to manufacture.

ANOTHER OBJECT of the present invention is to provide a cleaning device that is simple and effective to use.

BRIEFTLY STATED, STILL YET ANOTHER OBJECT of the present invention is to provide a cleaning device designed specifically for cleaning accumulated rust, asphalt, dirt, grim and salt debris from a trailer hitch receiver prior to hitching a trailer thereto. The cleaning device of the present invention is specifically designed to make the cleaning to a substantially square hitch receiver quick and complete thereby eliminating the use of dirty rags, clothes or just about anything that would fit into the hitch receiver to clean it. The use of dirty rags, clothes often takes much longer than necessary and only partially cleans the trailer hitch receiver. Therefore, the embodiments of the present invention described below facilitate proper cleaning of the trailer hitch receiver thereby making the hitching process less difficult.

This arrangement allows the corners areas inside the substantially square trailer receiver to be completely cleaned with minimum effort on the part of the user of the cleaning device because the traverse cross sectional shape of the cleaning device substantially matches at least part of the internal cross section of the trailer hitch receiver.

As stated above, the main object of the present invention is to provide a cleaning device that is configured to fit into a trailer hitch receiver and clean at least one side at a time, preferably two sides at a time in a fast and efficient way. This object is achieved by the cleaning device of the present invention, namely a cleaning device comprising an elongated stem attached to a handle member that is attached to a cleaning head. The cleaning head having a polygonal configuration wherein each of the sides of the polygonal configuration further comprises an abrasive surface configured for cleaning debris from a surface to which it is applied, thereby allowing a person to grasp the handle of the device and ream the cleaning head into a trailer hitch receiver to facilitate cleaning of accumulated road, salt and asphalt debris from said hitch receiver in a quick efficient way. The cleaning device of the present invention may also have a wire brush head.

The present invention is also directed to a process for cleaning a substantially square trailer hitch using the cleaning device described above comprising the following steps. First, inserting the cleaning device into the substantially square trailer hitch receiver and then moving the cleaning device from back to front and side to side against the inner surface of the substantially square trailer hitch to remove debris. The cleaning device is then flipped so that one of the sides of the cleaning device comes in direct contact with an unclean inner surface of the substantially square trailer hitch receiver and moving the cleaning device inserted into the substantially square trailer hitch from back to front and side to side against the inner surface of the substantially square trailer hitch removes accumulated debris; and c) repeating step b) until said trailer hitch is substantially free from debris.

The novel features which are considered characteristic of the present invention are set forth in the appended claims. The invention itself, however, both as to its construction and its method of operation, together with the additional objects and advantages thereof, will be best understood form the following description of the specific embodiments when read and understood in connection with the accompanying drawings.

DETAILED DESCRIPTION OF THE DRAWINGS

The present invention is directed to a cleaning device comprising and elongated stem, and handle and a cleaning head. The elongated stem can be attached to the handle at one end of the stem and to the cleaning head at the opposite end. This stem can be positioned in the center of one of the face surfaces of the cleaning head or off to one side so as to provide physical supportive structure that facilitates the application of additional pressure to aid in removing tough to remove debris from the hitch receiver.

To facilitate speed of cleaning, the cleaning device has a polygonal configuration with at least two sides, preferably three sides. The sides of the device are substantially flat and contain abrasive surfaces and/or contain wire bristles. The configuration of the present invention allows a person to grasp the handle of the device and ream the cleaning head into a trailer hitch receiver to facilitate cleaning of accumulated road, salt and asphalt debris from the hitch receiver in a quick and efficient way. As described in the figures, the polygonal head can be triangle in shape having three substantially flat surfaces that can be made from an abrasive material, can contain a holding means for attaching an abrasive pad so that the body of the brush can be used over and over again while the abrasive pads can be replaced.

Figures 4, 5:
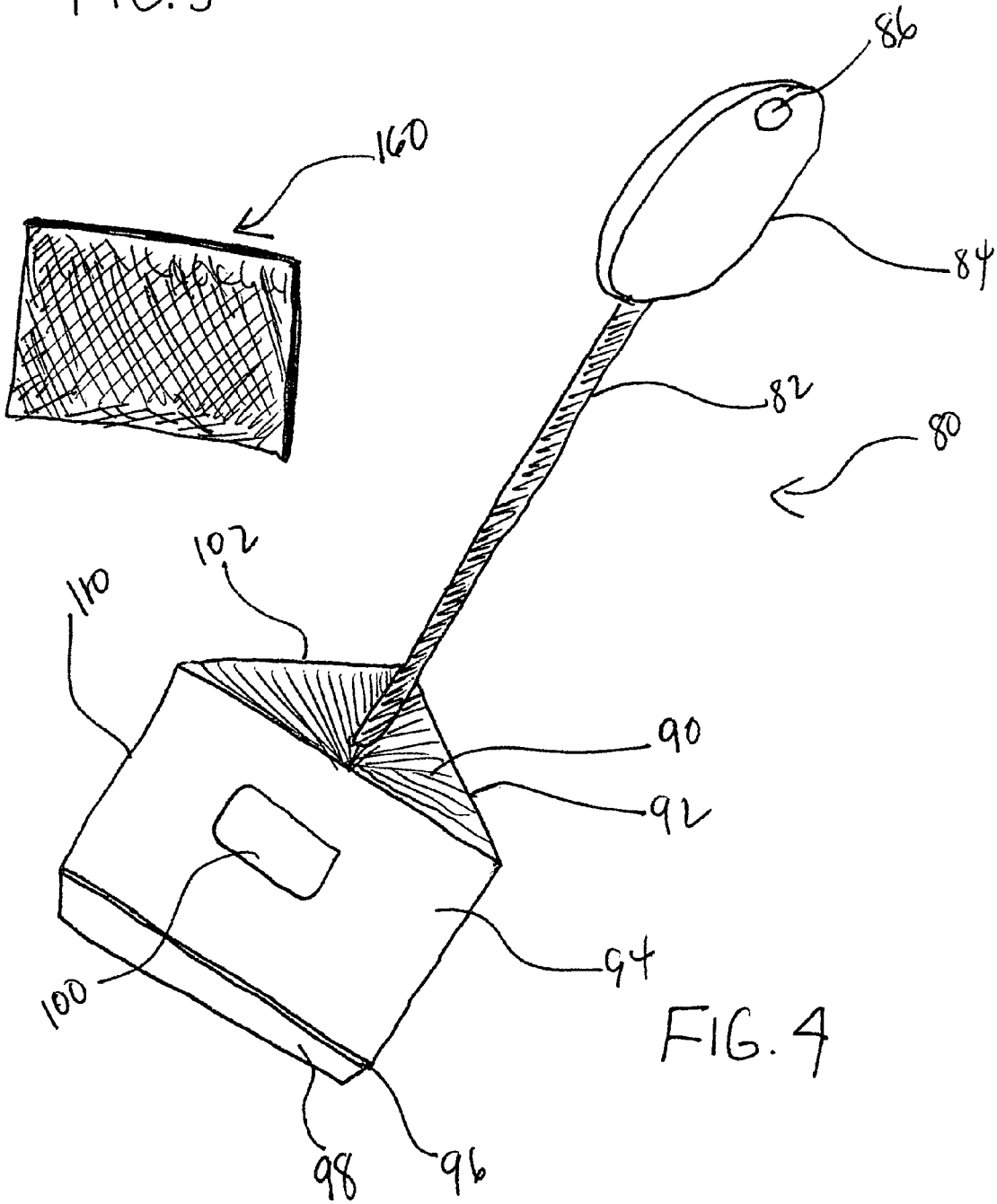
FIG. 4 is a diagrammatic cross sectional view of the triangular cleaning device having a detachable abrasive pad holder and a replaceable blade attached to an edge.
FIG. 5 is a diagrammatic cross sectional view of the abrasive replacement pad for the cleaning device of the present invention.

The pads can either be slide into an insert or can be attached using a removable holding means, as shown in FIGS. 4 and 5, such as Velcro®, two-sided tape, glue, or any other holding means that will hold the abrasive pads in place while being used, but allow them to be removed when they need to be replaced. It is clear that this can be achieved using a variety of ways, all of which are anticipated to fall within the scope of the invention and may be used in such a way as to assist in achieving the goals of the present invention. That is, to provide a device having an abrasive surface that can be used to clean a hitch receiver and permitting the abrasive surface to be replaced once it becomes in effective. In the alternative, the cleaning head may be constructed of wire bristles in the form of brush.

Figure 1:
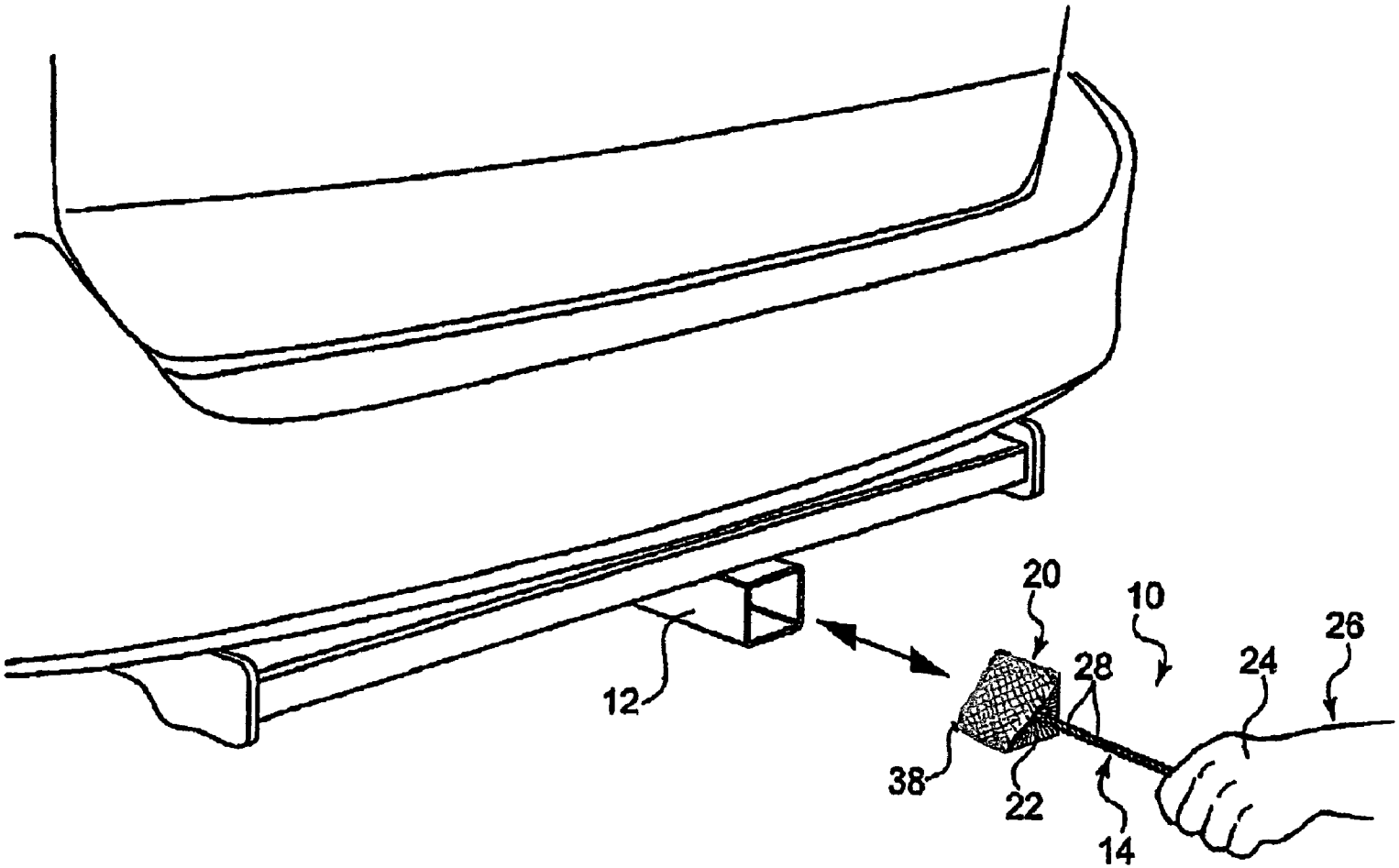
FIG. 1 is a diagrammatic cross sectional view of the cleaning device and a trailer hitch receiver attached to a tailgate.

FIG. 1 shows a diagrammatic cross sectional view of the triangular shaped cleaning device and a tailgate of a car with a hitch receiver. The tailgate has a trailer hitch receiver 12 and a cleaning device 10 held in the hand 24 of a person cleaning the hitch receiver. The elongated stem 28 is attached to the triangular head 20 on one of the faces of the triangular shaped cleaning device at point 22. The triangular head 20 having a sharpened edge 38 that can be used for cleaning off caked on grim on the inner walls of the trailer hitch receiver. The device can be thrusted into the hitch 12 by moving arm 26 of the user towards and away from the hitch 12 so as to clean the receiver portion of the hitch.

Figure 2:
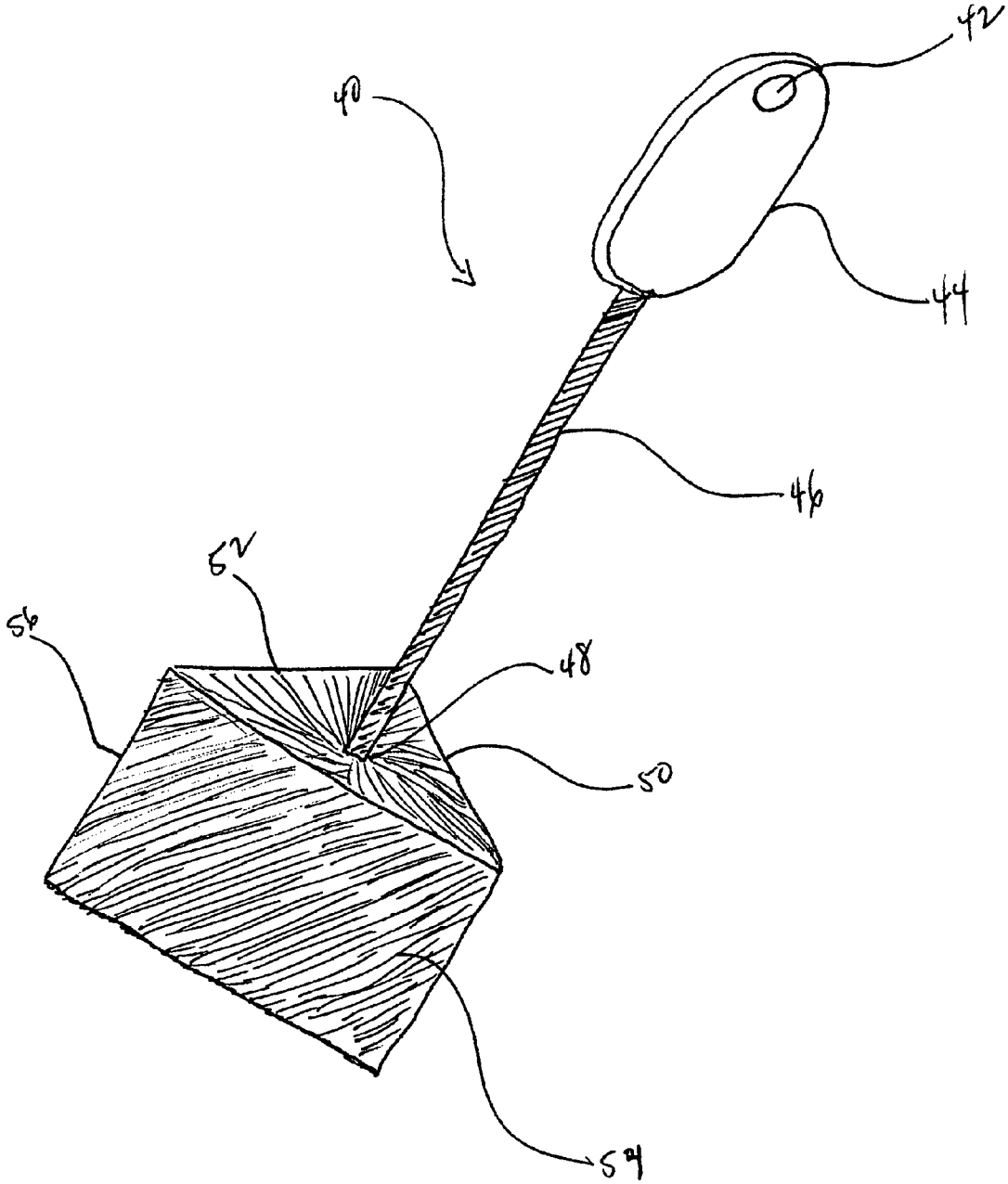
FIG. 2 is a diagrammatic cross sectional view of the triangular cleaning device of the present invention.

FIG. 2 shows a diagrammatic cross sectional view of the triangular cleaning device of the present invention 40. The triangular cleaning device 40 of the present invention has an elongated stem 46 attached to the triangular cleaning head 56 at point 48. The triangular cleaning head 56 has three faces 50, 52, and 54. The elongated stem 46 may be fitted with a handle 44. The handle 44 may be configured with a hole 42 that allows the user to store the cleaning device on a hook when not in use. The handle 44 can be used to hold the cleaning device while in use.

Figure 3:
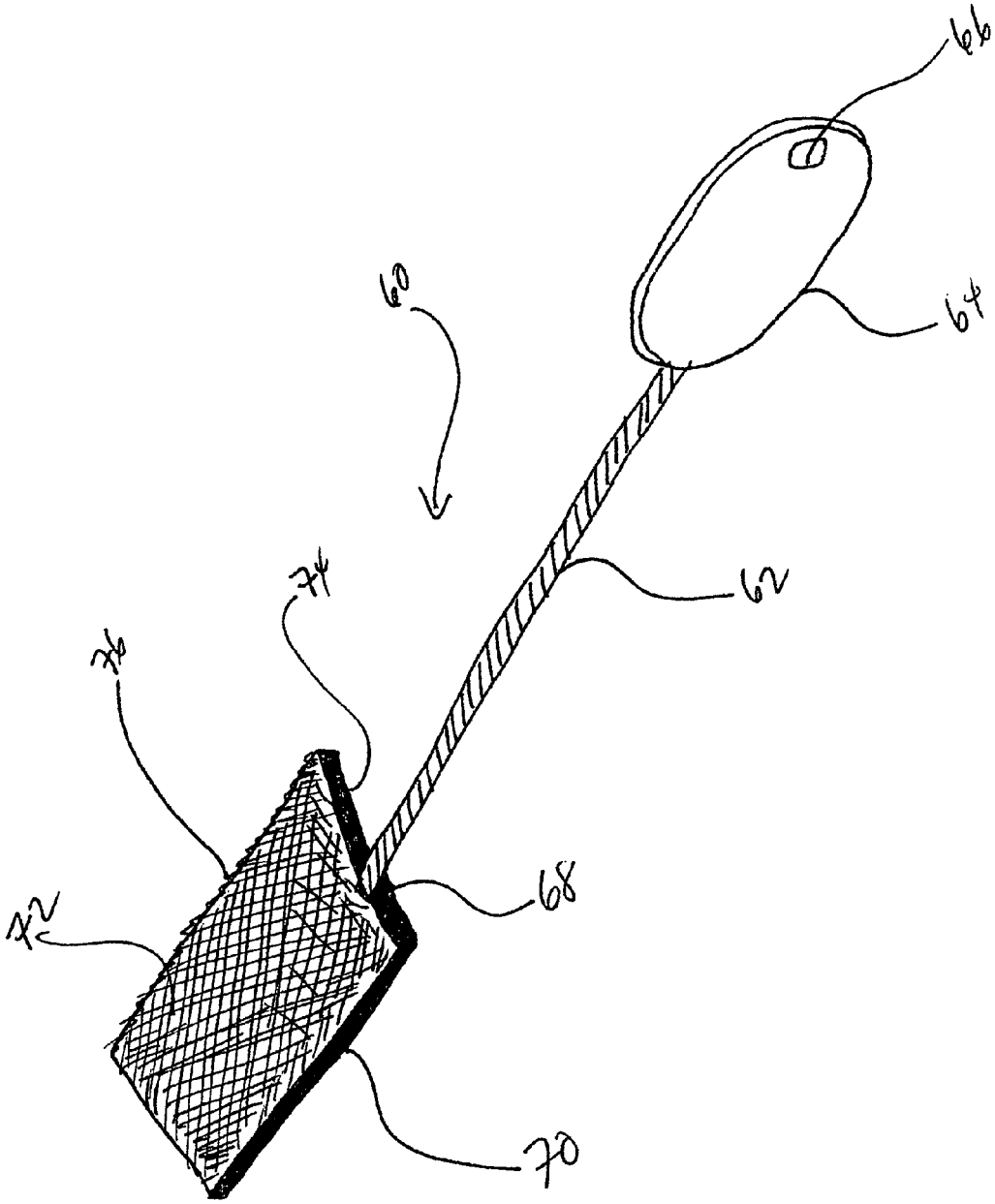
FIG. 3 is a diagrammatic cross sectional view of the two sided cleaning head of the present invention.

In an alternative embodiment of the present invention shown in FIG. 3, the cleaning head 76 is two sided, 72 and 74 and the elongated stem 62 is disposed at least partially between the two substantially flat surfaces in edge 70 at point 68. This allows a user to clean one surface of the hitch receiver at a time and flip the cleaning head to the next side once the previous side is cleaned. This cleaning head 76 will also fit into hitch receivers that are not square but are triangle in shape.

FIG. 4 shows is a diagrammatic cross sectional view of the triangular cleaning device having a detachable abrasive pad holder 100 and a replaceable blade 98 attached to an edge 96 of one of the surfaces 94 of the triangular cleaning head 110. The elongated stem 82 is attached to a handle 84 at one end and the triangular cleaning head 110 at the other. The elongated stem 82 is attached to surface 90 of the cleaning head 110. The detachable pad holder 110 of FIG. 4 is designed to receive the detachable pad 160. The holding means is designed to attach and remain in place so that the abrasive surface can be used to clean the inner portion of the trailer hitch but not so strong that the replaceable pad can not be removed when its abrasive properties are diminished. The holding means can be two sided tape, Velcro® or some type of adhesive that is both strong enough to hold the pad in place but weak enough to permit the pad to be removed. Other types of adhesives and holding means can be used to achieve the objective of the present invention and are envisioned to be part of the present invention.

FIG. 5 shows a diagrammatic cross sectional view of an abrasive replacement pad 160 that can be used to replace a worn pad on the cleaning device. A kit can be provided that contains at least one cleaning device, several abrasive pads, cleaning fluid, and instructions arranged in a carrying case.

The invention is also directed to a method for cleaning a trailer hitch receiver using the cleaning device of the present invention. That is, the cleaning devices of the present invention can be inserted into the trailer hitch receiver and at least one edge of the cleaning device aligned with at least one edge of the trailer hitch receiver. The cleaning device can be moved in and out of the hitch receiver with at least one abrasive surface of the cleaning device rubbing against the inner walls of the receiver thereby cleaning the wall of debris. With the edge of the triangular cleaning head lodged in the corner of the receiver, the cleaning head can be rotated to the next surface and the process repeated.

While the above description contains many specifics, these specifics should not be construed as limitations of the invention, but merely as exemplifications of preferred embodiments thereof. Those skilled in the art will envision many other embodiments within the scope and spirit of the invention as defined by the claims appended hereto.

What is claimed is:

1. A trailer hitch receiver and trailer hitch receiver cleaning device combination comprising a trailer hitch receiver; and a trailer hitch receiver cleaning device having an elongated stem, a handle and a cleaning head, said elongated stem being attached to said handle at one end and said cleaning head at the opposite end, said cleaning head having a polygonal configuration with at least two sides having abrasive surface, said cleaning head configured so that a diagonal dimension measured from a first corner of said cleaning head to a second corner of said cleaning head positioned diagonally from said first corner is substantially the same as a diagonal dimension measured from a first corner of the trailer hitch receiver to a second corner of the trailer hitch receiver so that said cleaning head is configured to fit tightly into the trailer hitch receiver, the trailer hitch receiver having inner walls that said abrasive surfaces are in contact with when inserted into said trailer hitch receiver and movement of said cleaning device in and out of said trailer hitch receiver rubs said abrasive surfaces against the walls of said trailer hitch receiver so as to loosen and remove debris from said walls of said trailer hitch receiver, facilitating cleaning of accumulated road, salt and asphalt debris from said receiver in a quick efficient way.

2. The combination of claim 1 wherein said cleaning head having a polygonal configuration is a square, or a rectangle.

3. The combination of claim 2 wherein said triangle cleaning head is an equilateral triangle having substantially equal angles and equal sides.

4. The combination of claim 2 wherein said elongated stem is attached to said square cleaning head substantially at the center of one of said equal sides.

5. The combination of claim 1 further comprising a sharp tapered blade attached to at least one of the sides of said polygon cleaning head so that said sharp tapered blade cuts away accumulated road, salt and asphalt debris from an inner surface of said hitch receiver in to which it is applied.

6. The combination of claim 5 wherein said blade is replaceable.

7. The combination of claim 1 wherein said abrasive surfaces are replaceable abrasive pads and said cleaning head further comprises at least one attachment means per side for attaching said abrasive replaceable pads to said cleaning head.

8. A process for cleaning a trailer hitch receiver claim 1 comprising;

a) providing the trailer hitch receiver and trailer hitch receiver cleaning device combination of claim 1 b) inserting said cleaning device in said trailer hitch receiver moving said cleaning device from back to front and side to side against at least one inner surface of said trailer hitch receiver to remove debris;

c) flipping said cleaning device so that one of said sides of said cleaning device comes in contact with an unclean inner surface of said trailer hitch receiver and moving said cleaning device in and out of said trailer hitch receiver against an inner surface of said trailer hitch receiver to remove debris; and d) repeating step c) until said trailer hitch is substantially free from debris.

9. The combination of claim 1 wherein said cleaning head comprises a plurality of outwardly facing bristles forming a substantially flat surface.

10. The combination of claim 1 wherein said cleaning head having a polygonal configuration with at least two sides is constructed of wire in the form of a wire brush.

* * * * *